US012788053B2

(12) United States Patent
Wang et al.

(10) Patent No.: US 12,788,053 B2
(45) Date of Patent: Nov. 10, 2026

(54) AEROSOL GENERATING DEVICE

(71) Applicant: ZHENGZHOU TOBACCO RESEARCH INSTITUTE OF CNTC, Zhengzhou City (CN)

(72) Inventors: Le Wang, Zhengzhou City (CN); Shuang Wang, Zhengzhou City (CN); Ke Zhang, Zhengzhou City (CN); Lili Fu, Zhengzhou City (CN); Zhongya Guo, Zhengzhou City (CN); Mingjian Zhang, Zhengzhou City (CN); Qi Zhang, Zhengzhou City (CN); Feng Huang, Zhengzhou City (CN); Bing Wang, Zhengzhou City (CN); Bin Li, Zhengzhou City (CN)

(73) Assignee: ZHENGZHOU TOBACCO RESEARCH INSTITUTE OF CNTC (CN)

( * ) Notice: Subject to any disclaimer, the term of this patent is extended or adjusted under 35 U.S.C. 154(b) by 503 days.

(21) Appl. No.: 18/566,923

(22) PCT Filed: May 25, 2022

(86) PCT No.: PCT/CN2022/094913
§ 371 (c)(1),
(2) Date: Dec. 4, 2023

(87) PCT Pub. No.: WO2022/253067
PCT Pub. Date: Dec. 8, 2022

(65) Prior Publication Data

US 2024/0277028 A1 Aug. 22, 2024

(30) Foreign Application Priority Data

Jun. 4, 2021 (CN) ..... 202110623740.0

(51) Int. Cl.
*A24D 1/20* (2020.01)
*A24D 1/02* (2006.01)
(Continued)

(52) U.S. Cl.
CPC ..... *A24D 1/20* (2020.01); *A24D 1/027* (2013.01); *A24F 40/20* (2020.01); *A24F 40/46* (2020.01)

(58) Field of Classification Search
CPC ..... A24D 1/20; A24D 1/027; A24F 40/46; A24F 40/20
See application file for complete search history.

(56) References Cited

U.S. PATENT DOCUMENTS

2016/0331032 A1* 11/2016 Malgat ..... A24F 40/40
2023/0115277 A1* 4/2023 Baur ..... A24D 3/043 131/329

FOREIGN PATENT DOCUMENTS

CN 108567170 A 9/2018
CN 111567890 A 8/2020
(Continued)

*Primary Examiner* — Michael H. Wilson
*Assistant Examiner* — Daniel Edward Vakili
(74) *Attorney, Agent, or Firm* — FBT Gibbons LLP

(57) ABSTRACT

Disclosed in the present invention is an aerosol generating device, comprising a housing and an aerosol medium, wherein one end of the housing is open, and an accommodating cavity and a heating body are arranged in the housing; the aerosol medium comprises an aerosol generating matrix segment and an aerosol extracting segment, a hollow cavity being disposed in the aerosol extracting segment, and the outer side wall of the aerosol extracting segment being provided with aerosol flow guide holes and air flow guide holes both in communication with the hollow cavity; after the aerosol medium extends into the accommodating cavity from the opening, the aerosol generating matrix segment is located in a heating area of the heating body, and the aerosol
(Continued)

can permeate from the outer side wall and end face of the aerosol generating matrix segment; the outer side wall of the aerosol medium has a gap with the inner wall of the housing and is in sealed fit with the housing at the open end face; the aerosol flow guide holes are positioned in the open end face, and the air flow guide holes are positioned outside the open end face. The aerosol generating device provided by the present invention reduces the transfer resistance of the aerosol, and increases the amount of smoke of an aerosol generating product.

10 Claims, 4 Drawing Sheets

(51) Int. Cl.
*A24F 40/20* (2020.01)
*A24F 40/46* (2020.01)

(56) References Cited

FOREIGN PATENT DOCUMENTS

| | | | |
|---|---|---|---|
| CN | 112135538 | A | 12/2020 |
| CN | 212877594 | U | 4/2021 |
| WO | WO 2020/025731 | A1 | 2/2020 |

* cited by examiner

AEROSOL GENERATING DEVICE

CROSS-REFERENCE TO RELATED APPLICATIONS

This application is a U.S. National Phase Patent Application of International Application Number PCT/CN2022/094913, filed on May 25, 2022, which claims the benefit of priority to the Chinese patent application No. 202110623740.0 filed on Jun. 4, 2021, the entire contents of each of which is hereby incorporated by reference.

FIELD OF THE INVENTION

The present invention relates to the field of novel aerosol products, and more particularly, to an aerosol generating device.

BACKGROUND OF THE INVENTION

Heat-not-burn aerosol generating devices (including heated cigarettes, low-temperature herbal products, and the like) generate aerosols by heating rather than igniting the aerosol generating matrix, which can greatly reduce the generation of harmful substances, and consumers can choose independently to start or stop aerosol generation. At present, the working principle of common heat-not-burn aerosol generating product is as follows: the aerosol generating matrix absorbs heat from the heat source to generate aerosols, and uses air as the carrier to filter the aerosols generated after the aerosol generating matrix is heated and then deliver them into the consumer's oral cavity.

There are basically three ways to achieve not-burn: the first is to replace combustibles; the second is to lower the temperature below the ignition point of the combustibles; and the third is to reduce the oxygen content of the combustion accelerant. In the prior art, for example, patents 202010241328.8 and 202010241686.9 respectively disclose an oxygen-depleted heating cigarette assembly and a closed heat-not-burn cigarette and assembly. The above-mentioned patents achieve aerosol generation and extraction of the aerosol generation matrix under the heat-not-burn state by sealing the aerosol generation matrix and changing the air flowing path, reducing the oxygen content in the region of the aerosol generation matrix. Since the transfer of the aerosol generally takes place along the axial direction of the cigarette and the axial size of the cigarette is larger than the radial size thereof, the problem in above-mentioned patents is when there is no fresh air flowing through the aerosol generation matrix, the aerosol transfer resistance is larger and the smoke amount of the aerosol generation product is less.

SUMMARY OF THE INVENTION

Accordingly, an object of the present invention is to provide an aerosol generating device that reduces the transfer resistance of the aerosol and increases the amount of smoke of aerosol generating articles.

In accordance with the above purposes, the present invention provides an aerosol generating device comprising a housing and an aerosol medium, wherein: the housing has one opened end, and an accommodating cavity is provided within the housing, and a heating body is arranged within the accommodating cavity; the aerosol medium comprises an aerosol generation matrix segment and an aerosol extraction segment which are abutted at the end surface, a hollow cavity penetrating the length of the aerosol extraction segment is arranged in the aerosol extraction segment, and an aerosol guiding hole and an air guiding hole which are communicated with the hollow cavity are arranged on the outer side wall of the aerosol extraction segment; when the aerosol medium extends into the accommodating cavity from the opening at the opened end, the aerosol generating matrix segment is positioned in the heating area of the heating body, when the heating body is heated, the aerosol can permeate out of the outer side wall and the end surface of the aerosol generating matrix segment, a gap is reserved between the outer side wall of the aerosol medium and the inner wall of the housing and is sealed and fitted with the housing at the opened end surface, the aerosol guiding hole is positioned inside the opened end surface, and the air guiding hole is positioned outside the opened end surface.

Optionally, the opened end surface is provided with a sealing member, and the sealing member is detachably and sealably mounted on the outer side wall of the aerosol medium when the aerosol medium extends into the accommodating cavity.

Optionally, the sealing member is an elastic sealing ring.

Optionally, the outer side wall of the aerosol generating matrix segment is made of a permeable material.

Optionally, at least one ventilation hole is opened on the outer side wall of the aerosol generating matrix segment, and the aerosol is able to permeate through the ventilation hole into the gap.

Optionally, the aerosol guiding holes penetrate through the aerosol extraction segment along a direction perpendicular to the length of the aerosol extraction segment; the air guiding holes penetrate through the aerosol extraction segment along the direction perpendicular to the length of the aerosol extraction segment.

Optionally, the aperture of the air guiding hole is equal to or larger than the aperture of the aerosol guiding hole.

Optionally, the number of the aerosol guiding holes is greater than or equal to the number of the air guiding holes.

Optionally, the aerosol medium further comprises a functional filter rod segment abutting the aerosol extraction segment at an end surface.

Optionally, the heating body surrounds and is mounted on the inner wall of the housing and/or the heating body is mounted on the bottom surface of the housing.

The aerosol generating device provided by the present invention comprises a housing and an aerosol medium, wherein the aerosol medium extends into an accommodating cavity from an opening of the housing, an aerosol guiding hole is positioned inside the open end surface, and an air guiding hole is positioned outside the open end surface, when a heating body heats an aerosol matrix, the aerosol permeated from the outer side wall of an aerosol matrix segment diffuses along a gap between the outer side wall of the aerosol medium and the inner wall of the housing and enters a hollow cavity through the aerosol guiding hole, and the aerosol permeated from the end surface of the aerosol matrix segment also diffuses into the hollow cavity, so that the transfer resistance of the aerosol is reduced. When a consumer smokes, the external air enters the hollow cavity through the air guiding holes, under the action of the Venturi effect and the Bernoulli principle, the aerosol directionally migrates in the hollow cavity along the direction close to the oral cavity of the consumer, and is mixed with the external air entering the hollow cavity to form mainstream smoke with a large amount of the smoke, so that the amount of the smoke of the aerosol generating product is increased, and the above mainstream smoke enters the oral cavity of the consumer through the functional filter rod segment.

BRIEF DESCRIPTION OF THE DRAWINGS

The preferred embodiments of the present invention will be described in detail below through the accompanying drawings, which will help understand the objects and advantages of the present invention, wherein.

DESCRIPTION OF THE REFERENCE NUMERALS

Figure 1:
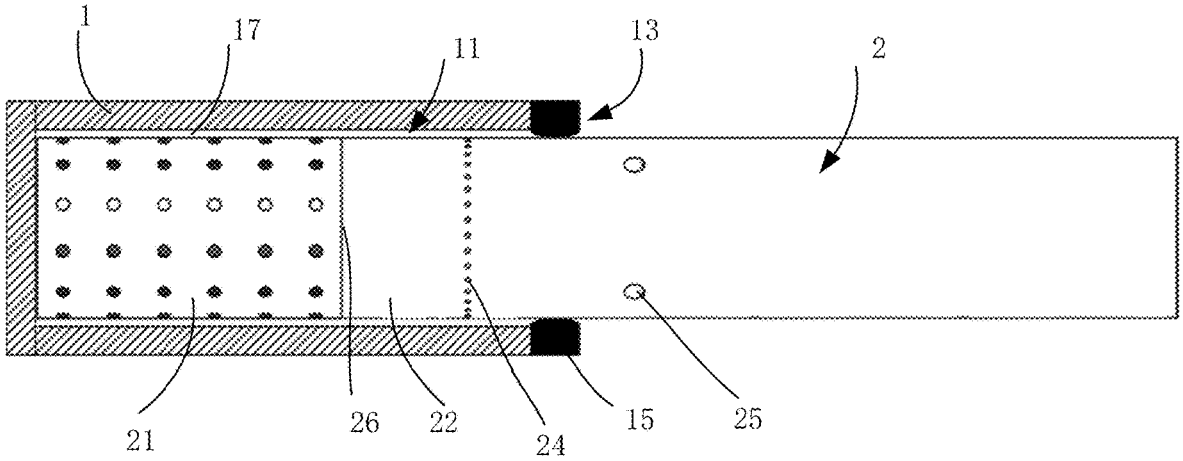
FIG. 1 is a schematic diagram of an aerosol generating device according to an embodiment of the present invention.

1: a housing; 2: an aerosol medium;

11: an accommodating cavity; 12: a heating body; 13: an opened end surface; 15: a seal member; 16: a bottom surface; 17: a gap;

21: an aerosol generating matrix segment; 22: an aerosol extraction segment; 23: a hollow cavity; 24: aerosol guiding holes; 25: air guiding holes; 26: an end surface; 27: ventilation holes; 28: a functional filter rod segment.

DETAILED DESCRIPTION OF THE EMBODIMENTS

The present invention will be described in detail with reference to embodiments. In which like parts are designated by like reference numerals. It should be noted that the terms "front," "back," "left," "right," "upper" and "lower" used in the following description refer to directions in the drawings, and the terms "inner" and "outer" refer to directions toward and away from, respectively, the geometric center of a particular part.

As shown in FIGS. 1 to 7, the present invention provides an aerosol generating device comprising a housing 1 and an aerosol medium 2, wherein: an opening is formed at one end of the housing 1, and an accommodating cavity 11 is arranged within the housing 1 and a heating body 12 is provided within the accommodating cavity 11; the aerosol medium 2 comprises an aerosol generating matrix segment 21 and an aerosol extraction segment 22 abutted against the end surface 26, a hollow cavity 23 penetrating the length of the aerosol extraction segment 22 is arranged within the aerosol extraction segment 22, and an aerosol guiding hole 24 and an air guiding hole 25 which are both communicated with the hollow cavity 23 are arranged on the outer side wall of the aerosol extraction segment 22. After the aerosol medium 2 extends into the accommodating cavity 11 from the opening, the aerosol generating matrix segment 21 is located in the heating area of the heating body 12, when the heating body 12 is heated, the aerosol can permeate from the outer side wall and the end surface 26 of the aerosol generating matrix segment 21, a gap is provided between the outer side wall of the aerosol medium 2 and the inner wall of the housing 1 and is sealed and fitted with the housing 1 at the opened end surface 13, the aerosol guiding holes 24 are located inside the opened end surface 13, and the air guiding holes 25 are located outside the opened end surface 13.

It should be noted that the aerosol generating matrix segment 21 completely enters into the accommodating cavity 11 and the aerosol extraction segment 22 enters partially into the accommodating cavity 11; the aerosol guiding hole 24 is positioned within the opened end surface 13 and is positioned in the housing 1, and the air guiding hole 25 is positioned outside the opened end surface 13 and is positioned outside the housing 1; the direction indicated by the arrows in the figure is the flow direction of the aerosol or air; the above heating body 12 comprises a power supply and a control module, and the control module is communicated with the power supply to control the start or the stop of the heating body 12. In addition, the aerosol medium 2 is detachably connected with the housing 1 so as to facilitate the replacement of the aerosol medium 2; the aerosol generating matrix segment 21 and the aerosol extraction segment 22 may be coaxially arranged.

The aerosol generating device provided in the present invention comprises a housing 1 and an aerosol medium 2, wherein the aerosol medium 2 is extended into an accommodating cavity 11 from an opening of the housing 1, and an aerosol guiding hole 24 is positioned within an opened end surface 13, an air guiding hole 25 is positioned outside the opened end surface 13, when a heating body 12 heats an aerosol matrix, the aerosol permeated from an outer side wall of an aerosol matrix segment diffuses along a gap between the outer side wall of the aerosol medium 2 and an inner wall of the housing 1 and enters a hollow cavity 23 through the aerosol guiding hole 24, and the aerosol permeated from an end surface 26 of the aerosol matrix segment also diffuses into the hollow cavity 23, so that the transfer resistance of the aerosol is reduced. When a consumer smokes, external air enters the hollow cavity 23 through the air guiding holes 25, and under the action of the Venturi effect and the Bernoulli principle, the aerosol migrates in the hollow cavity 23 in a direction close to the smoker's oral cavity (as shown by the arrow direction in FIG. 5), and is mixed with the external air entering the hollow cavity 23 to form mainstream smoke with a large amount of smoke, so that the smoke volume of the aerosol generating product is increased.

Figure 5:
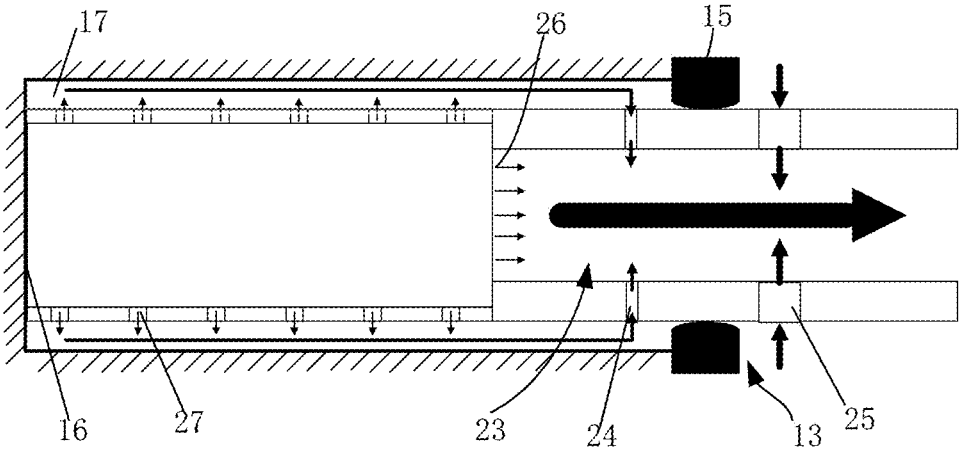
FIG. 5 is a schematic diagram of the airflow direction in an aerosol generating device according to an embodiment of the present invention.
Figure 6:
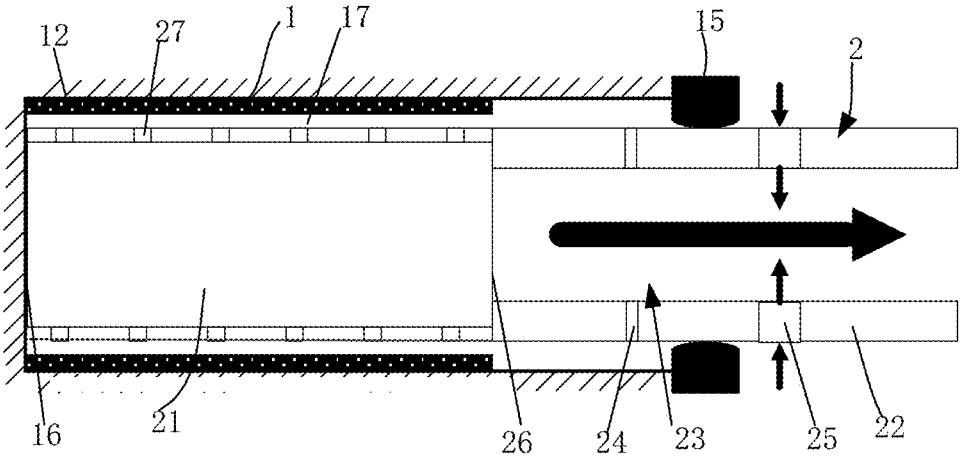
FIG. 6 is a schematic diagram of the installation of a heating body in an aerosol generating device according to an embodiment of the present invention.
Figure 7:
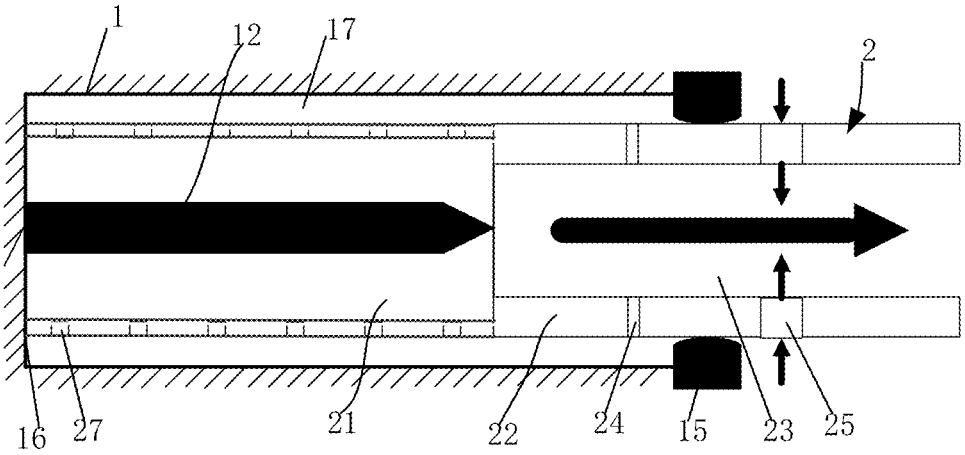
FIG. 7 is a schematic diagram of the installation of a heating body in an aerosol generating device according to another embodiment of the present invention.

As shown in FIGS. 5, 6 and 7, the opened end surface 13 is provided with a sealing member 15, and the sealing member 15 is detachably and sealably mounted on the outer side wall of the aerosol medium 2 when the aerosol medium 2 is extended into the accommodation chamber 11. It should be noted that the sealing member 15 may be detachably and sealably mounted on the opened end surface 13 by means of meshing, concave-convex fitting, or the like; the sealing 15 may be sealed with the outer side wall of the aerosol medium 2 through an interference fit. In this embodiment, the outer side wall of the aerosol medium 2 is sealed with the housing 1 at the opened end surface 13 through the sealing member 15, when the sealing member 15 needs to be replaced, the sealing member 15 is detached from the opened end surface 13, and a new sealing member 15 is mounted on the opened end surface 13, so that the convenience in maintenance operation of the aerosol generating device is improved. Specifically, the sealing element 15 is an elastic sealing ring, the sealing ring is cheap and convenient to purchase, and the production cost of the aerosol generating device is reduced.

Figure 3:
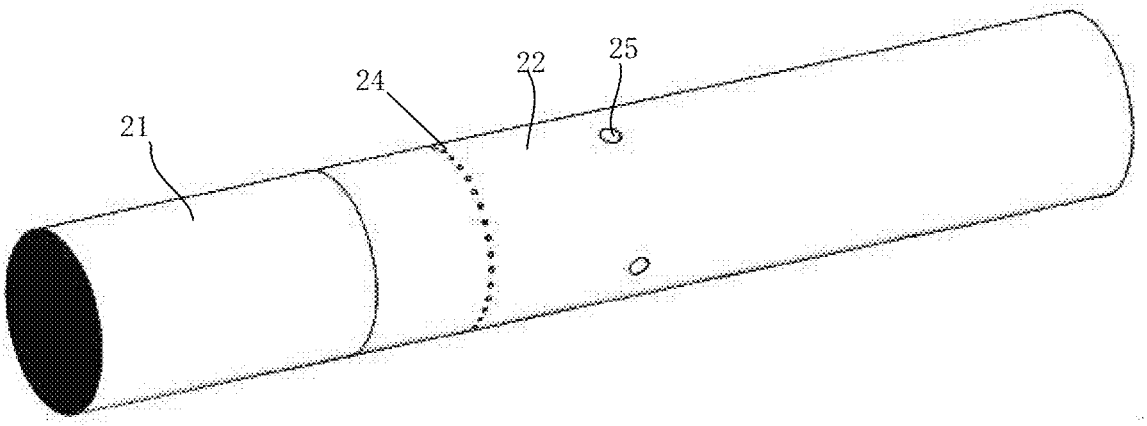
FIG. 3 is a schematic structural diagram of an aerosol medium according to another embodiment of the present invention.

As shown in FIG. 3, the outer side wall of the aerosol generating matrix segment 21 is made of an air permeable material. It should be noted that the above-mentioned air permeable material may be high permeability papers, a non-woven fabric, or the like. The aerosol generating matrix is wrapped by high permeability papers or non-woven fabric to form an aerosol generating matrix segment 21, and the aerosol can permeate into the gap between the outer side wall of the aerosol medium 2 and the inner wall of the housing 1 through the high permeability paper or the non-woven fabric. In this embodiment, the permeable material is easy to purchase, and the processing method for wrapping the aerosol generating matrix with the permeable material to form the aerosol generating matrix segment 21 is simple and easy to be operated, so that the convenience in processing and production of the aerosol generating matrix segment 21 is improved, and the production convenience of the aerosol generating device is further improved.

Figure 2:
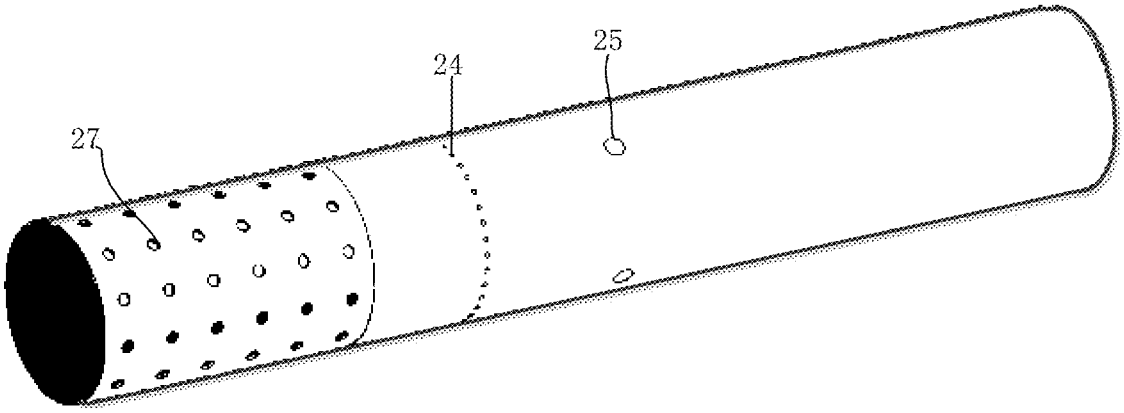
FIG. 2 is a schematic structural diagram of an aerosol medium according to an embodiment of the present invention.

As shown in FIG. 2, at least one ventilation hole 27 is provided on the outer side wall of the aerosol generating matrix segment 21, and the aerosol can pass through the ventilation hole 27 into the gap therefrom. It should be noted that the plurality of ventilation holes 27 may be arranged in an ordered manner or randomly along the circumferential direction of the outer side wall of the aerosol generating matrix segment 21. In this embodiment, the ventilation holes 27 increase the size of the aerosol flow path through which the aerosol can pass more easily from the outer side wall of the aerosol generating matrix segment 21, thereby increasing the amount of smoke in the aerosol generating product.

As shown in FIGS. 4, 5, 6 and 7, the aerosol guiding holes 24 extend through the aerosol extraction segment 22 in a direction perpendicular to the length of the aerosol extraction segment 22; the air guiding holes 25 extend through the aerosol extraction segment 22 in a direction perpendicular to the length of the aerosol extraction segment 22. It should be noted that there may be a plurality of aerosol guiding holes 24, and the plurality of aerosol guiding holes 24 are arranged along the circumferential direction of the outer side wall of the aerosol extraction segment 22; there also can be a plurality of air guiding holes 25, and the plurality of air guiding holes 25 are arranged along the circumferential direction of the outer side wall of the aerosol extraction segment 22. In this embodiment, the aerosol guiding holes 24 and the air guiding holes 25 are both through holes, which are easy to process, so that the convenience of processing holes on the aerosol extraction segment 22 is improved; in addition, the through holes increase the flow smoothness of the airflow, improve the airflow flowing efficiency and further enable the aerosol generating device to generate a larger amount of smoke quickly.

As shown in FIGS. 4, 5, 6 and 7, in this embodiment, the aperture of the air guiding hole 25 is equal to or larger than the aperture of the aerosol guiding hole 24, so that when the consumer smokes, the aerosol can more smoothly enter the oral cavity of the consumer through the hollow cavity 23, thereby improving the convenience of extracting the aerosol.

In one embodiment of the present invention, the number of the aerosol guiding holes 24 is greater than or equal to the number of the air guiding holes 25, so as to reduce the transfer resistance of the aerosol, and further increase the smoke amount of the aerosol generating product.

Figure 4:
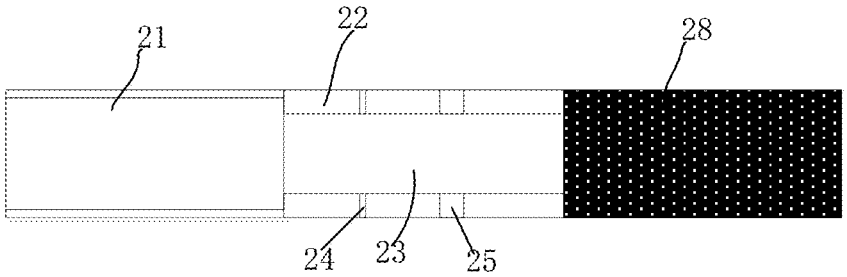
FIG. 4 is a schematic cross-sectional view of an aerosol medium in accordance with an embodiment of the invention.

As shown in FIG. 4, the aerosol medium 2 further comprises a functional filter rod segment 28 that abuts with the aerosol extraction segment 22 at an end surface. It should be noted that the aerosol medium 2 may have a cylindrical structure, and the aerosol generating matrix segment 21, the aerosol extraction segment 22, and the functional filter rod segment 28 are all being coaxially arranged. In this embodiment, the functional filter rod segment 28 may be provided with a filtering structure or a flavor substance loading and releasing structure, or a combination of these structures, so as to reduce the entrance of harmful substances into the oral cavity of the consumer and improve the comfort level of the consumer.

In an embodiment of the present invention, the heating body 12 surrounds and is mounted on the inner wall of the housing 1 and/or the heating body 12 is mounted on the bottom surface 16 of the housing 1. It should be noted that the inner wall of the housing 1 includes a bottom inner wall of the housing 1. As shown in FIG. 6, when the heating body 12 is circumferentially heated, the heating body 12 surrounds and is installed on the inner wall of the housing 1. Specifically, the outer side wall of the heating body 12 is installed on and attached to the inner wall of the housing 1, a gap is left between the inner side wall of the heating body 12 and the outer side wall of the aerosol medium 2, and the heating body 12 heats the aerosol generating matrix segment 21 around the outer side wall and the end surface of the aerosol generating matrix segment 21; as shown in FIG. 7, when the heating body 12 is centrally heated, the heating body 12 is mounted on the bottom surface 16 of the housing 1 and inserted into the aerosol generating matrix. It should be noted that the bottom surface 16 of the housing 1 is disposed opposite to the opened end surface 13 of the housing 1. In this embodiment, the different mounting manners of the heating body 12 improve the applicability of the aerosol generating device.

The following is under the same experimental conditions (sucking mode, heating temperature, capturing method, etc.), using the same aerosol generation matrix (the experiment uses the same amount of ordered filled tobacco sheets), capturing particulate matter in different airflow modes and weighed, and the average value is taken.

Figure 8:
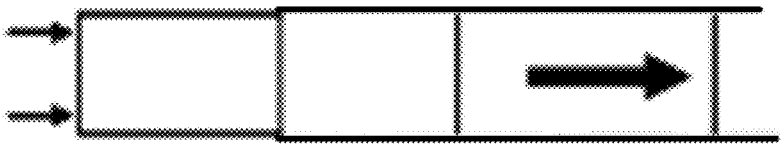
FIG. 8 is a schematic diagram of an end-intake aerosol generating device in the prior art.
Figure 9:
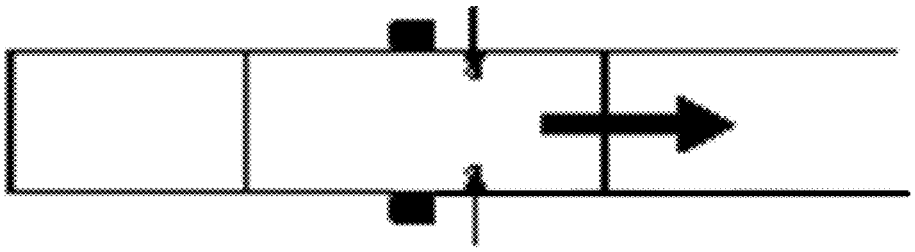
FIG. 9 is a schematic diagram of an aerosol generating device with air intake through side wall holes in the prior art.

It should be noted that as shown in FIG. 8, end air intake means that air enters from the end of the aerosol generating matrix, the entering air moves toward the consumer's oral cavity with the generated aerosol; the side wall through-hole air intake as shown in FIG. 9 means that the air enters from the through-hole of the aerosol extraction segment, and the entering air moves toward the consumer's oral cavity with the generated aerosol. The weighing of the above-mentioned particulate matter is performed in the following manners: first, the smoking machine is smoked according to a certain mode; then, all the particulate matters in the extracted smoke is collected by using a filter sheet; finally, the collected particulate matter is weighed. The experimental results are as follows: in the prior art, the total particulate matter obtained by using end air intake is 45.3 g/mg, the total particulate matter obtained by using side wall through-hole air intake is 44.9 g/mg, and the weight of the total particulate matter generated by using end air intake and side wall through-hole air intake is comparable; the weight of the total particulate matter weight generated by using the air intake method adopted in one embodiment of the present invention is 68.6 g/mg, and compared with the prior art, the particulate matter weight is increased by nearly 50%, i.e., the aerosol generating device adopted by the present invention increases the smoke amount of the aerosol generating product.

The aerosol generating device provided in the present invention comprises a housing 1 and an aerosol medium 2, wherein the aerosol medium 2 extends into an accommodating cavity 11 from an opening of the housing 1, an aerosol guiding hole 24 is positioned in an opened end surface 13, an air guiding hole 25 is positioned outside the opened end surface 13, when a heating body 12 heats an aerosol matrix, the aerosol permeated from an outer side wall of an aerosol matrix segment diffuses along a gap between the outer side wall of the aerosol medium 2 and an inner wall of the housing 1 and enters a hollow cavity 23 through the aerosol guiding hole 24, and the aerosol permeated from an end surface 26 of the aerosol matrix segment also diffuses into the hollow cavity 23, so that the transfer resistance of the aerosol is reduced. When a consumer smokes, the external air enters the hollow cavity 23 through the air guiding holes 25, and under the action of the Venturi effect and the Bernoulli principle, the aerosol directionally migrates in the hollow cavity 23 in a direction close to the oral cavity of the consumer (as shown in the arrow direction in FIG. 5), and is mixed with the external air entering the hollow cavity 23 to form mainstream smoke with a large amount of the smoke, so that the amount of the smoke of the aerosol generating product is increased, and the mainstream smoke enters the oral cavity of the consumer through the functional filter rod segment 28.

Finally, it should be noted that, the above embodiments are only intended to illustrate the technical solution of the present invention, and not to limit them; although the present invention has been described in detail with reference to the foregoing embodiments, it should be understood by those of ordinary skill in the art that: the technical solutions described in the foregoing embodiments may still be modified, or some technical features may be equivalently replaced; and such modifications or substitutions do not depart from the spirit of the corresponding technical solutions of the embodiments of the present invention.

What is claimed is:

1. An aerosol generating device comprising a housing and an aerosol medium, wherein:

said housing is provided with an inner wall and one opened end, and an accommodating cavity is provided within said housing, and a heating body is arranged within said accommodating cavity;

said aerosol medium comprises an aerosol generation matrix segment and an aerosol extraction segment which are abutted at an end surface, a hollow cavity penetrating the length of the aerosol extraction segment is arranged in the aerosol extraction segment, and an aerosol guiding hole and an air guiding hole which both are communicated with the hollow cavity are arranged on an outer side wall of the aerosol extraction segment;

when the aerosol medium extends into the accommodating cavity from said opened end, the aerosol generating matrix segment is located within the heating area of the heating body, when the heating body is heated, the aerosol is able to permeate out of an outer side wall and an end surface of the aerosol generating matrix segment, a gap is provided between an outer side wall of the aerosol medium and the inner wall of the housing and is sealed and fitted with the housing at the opened end surface, the aerosol guiding hole is located inside the opened end surface, and the air guiding hole is located outside the opened end surface.

2. The aerosol generating device according to claim 1, characterized in that the opened end surface is provided with a sealing member which is releasably sealably mounted on the outer side wall of the aerosol medium when the aerosol medium extends into said accommodating cavity.

3. The aerosol generating device according to claim 2, characterized in that the sealing member is a resilient sealing ring.

4. The aerosol generating device according to claim 3, characterized in that the outer side wall of the aerosol generating matrix segment is made of a permeable material.

5. The aerosol generating device according to claim 3, characterized in that at least one ventilation hole is opened on the outer side wall of the aerosol generating matrix segment, through which the aerosol can permeated into the gap.

6. The aerosol generating device according to claim 5, characterized in that the aerosol guiding hole penetrates through the aerosol extraction segment along a direction perpendicular to the length of the aerosol extraction segment; the air guiding hole penetrates through the aerosol extraction segment along the direction perpendicular to the length of the aerosol extraction segment.

7. The aerosol generating device according to claim 6, characterized in that the aperture of the air guiding hole is equal to or larger than the aperture of the aerosol guiding hole.

8. The aerosol generating device according to claim 7, characterized in that the number of the aerosol guiding holes is greater than or equal to the number of the air guiding holes.

9. The aerosol generating device according to claim 8, characterized in that the aerosol medium further comprises a functional filter rod segment abutting the aerosol extraction segment at an end surface.

10. The aerosol generating device according to claim 1, characterized in that the heating body surrounds and is mounted on the inner wall of the housing and/or the heating body is mounted on the bottom surface of the housing.

* * * * *